US006416258B1

(12) United States Patent
Chang

(10) Patent No.: US 6,416,258 B1
(45) Date of Patent: Jul. 9, 2002

(54) GROUND ADVANCE SHORING SYSTEM

(76) Inventor: Chi-Kuang Chang, 13 F1., No. 285 Sec. 4, Chung-Shao E. Rd., Taipei (TW)

( * ) Notice: Subject to any disclaimer, the term of this patent is extended or adjusted under 35 U.S.C. 154(b) by 0 days.

(21) Appl. No.: 09/636,786

(22) Filed: Aug. 11, 2000

(30) Foreign Application Priority Data

Jan. 7, 2000 (TW) ..... 89100210

(51) Int. Cl.[7] ..... E01D 21/06; E21D 23/08

(52) U.S. Cl. ..... 405/272; 405/292; 404/85; 14/77.1

(58) Field of Search ..... 405/272, 288, 405/291–303; 14/77.1, 78; 404/85

(56) References Cited

U.S. PATENT DOCUMENTS 3,902,212 A * 9/1975 Muller ..... 14/77.1
4,282,978 A * 8/1981 Zambon ..... 212/312
5,511,268 A * 4/1996 Albus et al. ..... 14/77.1
5,987,680 A * 11/1999 Sakaya ..... 14/77.1 X
6,170,106 B1 * 1/2001 Tsimmerman et al. ... 14/77.1 X

* cited by examiner

*Primary Examiner*—Robert E. Pezzuto
*Assistant Examiner*—Tara L. Mayo
(74) *Attorney, Agent, or Firm*—Ladas & Parry

(57) ABSTRACT

This invention is related to a ground advance shoring system and the construction method using such a system. The system of this invention comprises a railway assembly for being set up on a ground; at least one movable device disposed on the railway assembly for moving thereon, in which the movable device includes a moving platform and a bottom jack provided below the moving platform for lifting and releasing the moving platform; when the bottom jack lifts the moving platform, the movable device is separated from the railway assembly and unable to move along the railway assembly, whereas when the bottom jack releases the moving platform, the movable device engages the railway assembly for moving thereon; a plurality of framework supporting units being vertically stacked on the movable device to form a supporting tower; and a top jack assembly being provided above the supporting tower and a mold supporting frame being provided on the top jack assembly, and a mold plate assembly being set up on the mold supporting frame; wherein the top jack assembly is provided for adjusting longitudinal and traverse gradients of the mold supporting frame.

17 Claims, 14 Drawing Sheets

GROUND ADVANCE SHORING SYSTEM

FIELD OF INVENTION

This invention is related to a ground advance shoring system and the construction method using such a system. This invention is primarily utilized in the construction of elevated roads or bridges. By utilizing the method and system according to this invention, construction costs can be significantly reduced and the work period can be shortened along with improved construction efficacy.

BACKGROUND OF INVENTION

The conventional construction systems for elevated roads or bridges can be generally categorized into a stationary shoring system and an advancing shoring system. To facilitate better understanding of the technical features and advantages of this invention, the above two conventional construction methods are summarized as follows.

The conventional stationary shoring system, as illustrated in FIGS. 1 and 2, generally includes stationary supporting frames 11 set up on the ground 10, and molding plates 16 along with other facilities installed on the supporting frames 11 for subsequent casting of bridge concrete 15. The conventional stationary shoring construction method includes ground conditioning and pavement of one or several layers of gravel (not shown) thereon. Concrete blocks 13 are then covered on the gravel. Next, a plurality of supporting frame units 14, as illustrated in FIG. 3, are connected by screws and/or connection rods to form the complete supporting frames 11 on the concrete blocks 13 as shown in FIGS. 1 and 2. After completing the installation of the supporting frames 11, additional supporting facility, such as steel H-beams 12 and wooden corners (not shown) etc., are installed on the supporting frames 11 and the molding plates 16 are installed on the supporting facility for subsequent pouring of the bridge concrete 15.

The above conventional stationary shoring construction method involves many disadvantages. Firstly, since the loading capacity for a single supporting frame unit 14 is very limited, the overall supporting frames 11 must be connected as a dense supporting network by a large number of the supporting frame units 14 so as to evenly distribute the weights of the supporting frames 11 themselves and the bridge concrete 15 over each of the supporting frame units 14 for safe and sufficient support. Accordingly, the conventional stationary shoring construction method requires a considerable a mount of materials for the supporting frames. Secondly, each of the supporting frame units 14 must be connected by screws, connection rods or other means (not shown) one by one and thus, the installation or dismantling thereof is thus very time-consuming. In addition, the conventional stationary shoring construction method needs movable or fixed concrete blocks 13 such that the weight of the bridge concrete 15 can be evenly distributed on the ground 10. For the concrete blocks 13 not to be moved, they need to be demolished and shipped away after the completion of the construction. This results in considerable waste of concrete material and requires additional manpower, materials and construction time. For the movable concrete blocks 13, heavy machinery for moving them is necessary and thus, it still requires substantial manpower and working time.

In the conventional stationary shoring construction method, each of the supporting points 17 needs to be leveled prior to the pavement of the steel H-beams 12 over th e supporting frames 11. As can be seen in FIGS. 1 and 2, the amount of supporting points 17 is enormous. Therefore, the time for leveling them is very long. Furthermore, crane truck(s) is/are required to remove and dismantle the supporting frames 11. Here, a "series of supporting frames" means a plurality of the supporting frame units 14 connected in a vertical direction. The supporting frames 11 shown in FIGS. 1 and 2 are usually disconnected horizontally only, but not vertically, so as to save some time and manpower for the dismantling. Each series of the supporting frames is tilted and put on a truck by the crane truck for subsequent construction process of the next span. If the supporting frames 11 are too high, the usual crane truck would not be able to reach them. Accordingly, a heavy crane truck will be necessary which results in additional costs, machinery and manpower along with increased difficulty in operation.

The advancing shoring system is generally illustrated in FIG. 4, characterized in that each of the left and right sides of the concrete post 20 of the bridge has a recess 21. A bracket 22 can be mounted into the recess 21 and a slidable truss 23 is provided on the bracket 22. Steel H-beams 24, molding plates 25 and/or other facilities similar to those utilized in the conventional stationary shoring system can be installed on the truss 23 for the casting of the bridge concrete 26. After completing the casting of each span of the bridge concrete 26, the molding plates 25 will be lowered and separated. The advancing shoring system then employs a driving means (not shown) to move the truss 23 to the next span, as illustrated in FIG. 5. The molding plates 25 will be re-installed again to repeat the casting of the bridge concrete 26. As compared with the conventional stationary shoring system, the advancing shoring system requires less supporting materials. In addition, the manpower and time for installing and dismantling the supporting frames can be eliminated with significant improvement on the construction efficiency. Nevertheless, the advancing shoring system still has some disadvantages. Firstly, the recesses 21 need to be formed on each of the precasted concrete posts 20, as illustrated in FIG. 4, which increases the inconvenience in the construction processes. Secondly, the dimensions and weight of the truss 23, usually made of steel, used in the system are generally enormous, approximately 600–700 tons, to provide sufficient supporting strength. Since the complete weight of the truss 23 must be supported by the concrete post 20, the design of it needs to be changed when this is taken into consideration. Furthermore, the technique of the advancing shoring construction method is more difficult than that of the conventional stationary shoring construction method. Collapse of the supporting facility when moving the system to the next span can happen and thus, extreme caution is definitely required in the advancing shoring construction method. The current costs for an advancing shoring system is generally more than one million U.S. dollars, which is relatively expensive. In addition, at least two crane trucks with more than one hundred ton capacity are required for at least 45 days. Thus, the craning job in the advancing shoring construction method is not only quite difficult but also expensive. For example, if the cost for the crane is US$300 per day, the basic cost for the crane trucks would be 300 (US$/truck)×2 (truck/day)×45 (days)= US$27,000. Accordingly, if the number of spans for continuous construction is not large enough, that is, the construction length of the elevated road or bridge is not long, the actual costs for the advancing shoring construction method is not necessarily lower than that of the conventional stationary construction method.

SUMMARY OF INVENTION

It is therefore a primary object of this invention to overcome the above defects of the conventional art. This invention discloses a ground advance shoring system and the construction method using such a system. The system of this invention comprises a railway assembly for being set up on a ground; at least one movable device disposed on the railway assembly for moving thereon, in which the movable device includes a moving platform and a bottom jack provided below the moving platform for lifting and releasing the moving platform; when the bottom jack lifts the moving platform, the movable device is separated from the railway assembly and unable to move along the railway assembly, whereas when the bottom jack releases the moving platform, the movable device engages the railway assembly for moving thereon; a plurality of framework supporting units being vertically stacked on the movable device to form a supporting tower; and a top jack assembly being provided above the supporting tower and a mold supporting frame being provided on the top jack assembly, and a mold plate assembly being set up on the mold supporting frame; wherein the top jack assembly is provided for adjusting longitudinal and traverse gradients of the mold supporting frame.

With respect to the ground advance shoring construction method according to this invention, generally comprises the steps of (a) paving and leveling aggregate on a generally conditioned ground; (b) covering a plurality of lining plates on the aggregate; (c) paving at least one railway on the lining plates; (d) locating at least one movable device on the railway, in which the movable device includes a moving platform and a bottom jack provided below the moving platform, so that the moving platform is lifted away from the railway and supported by the bottom jack when the movable device is moved to a designated position; (e) vertically stacking and securely locking a plurality of framework supporting units on the movable device to form a supporting tower; (f) locating a top jack assembly on the supporting tower and then locating a mold supporting frame on the top jack assembly, in which the top jack assembly is provided for adjusting longitudinal and traverse gradients of the mold supporting frame; and (g) setting up a mold plate assembly on the mold supporting frame.

The set of mold plate assembly is then ready for concrete casting. After the concrete being cured, the mold plate assembly is lowered and separated from the concrete and the bottom jack is released such that the movable device resumes engaging the railways. Then the movable device and the supporting tower thereon is moved to a next designated position, the movable device is lifted and secured by the bottom jack, and the mold plate assembly is again installed for concrete casting.

The ground advance shoring construction method and the utilized system according to this invention involves many advantages. Firstly, as compared with the conventional stationary shoring construction method, the framework supporting unit utilized in this invention has a larger volume than that of the traditional supporting frame unit. Therefore, for supporting structures of identical height, the number of the framework supporting units required in this invention can be considerably reduced as compared with that of the traditional supporting frames and thus, the time for installation thereof can be shortened. Secondly, since the number of the supporting towers of this invention is far less than the number of the conventional supporting frames and the large mold supporting frames are used on top of the supporting towers, the number of supporting points is dramatically reduced in this invention, and so is the time for leveling them. Furthermore, there is no need to dismantle the supporting towers of this invention after completing the concrete casting of each span. The movable device and the supporting tower thereon can be directly moved to the next span by an electric motor, winch or even manually, so as to save time for dismantling and re-assembly of the supporting frames.

As compared with the conventional advancing shoring construction method, it is unnecessary for this invention to reserve recesses on the concrete posts, therefore, no variation regarding the design of the concrete post is required. In addition, the construction techniques utilized in this invention are considered much easier than those of the advancing shoring construction method. The working time, manpower and costs of this invention are also reduced, and no additional training program is required for the workers, as is necessary for the conventional advancing shoring construction method. Specifically, the construction of the supporting facilities of this invention is relatively simple and the cost thereof is obviously less than that of the conventional advancing shoring system.

The structures and characteristics of this invention can be clearly realized by referring to the appended drawings and explanations of the preferred embodiments.

EXPLANATIONS OF PREFERRED EMBODIMENTS

Figure 6:
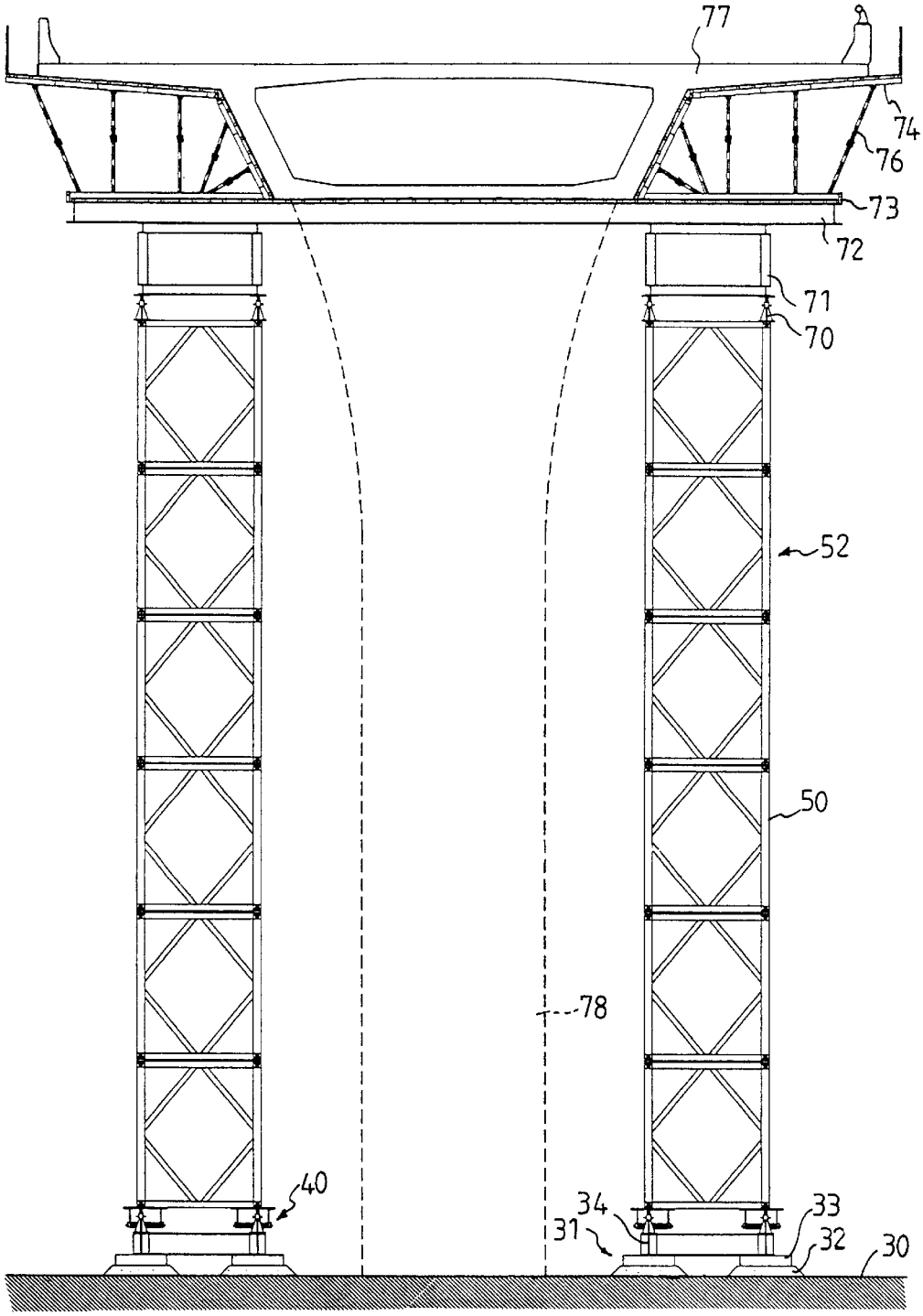
FIG. 6 is a schematic view of the ground advance shoring system according to this invention.
Figure 7:
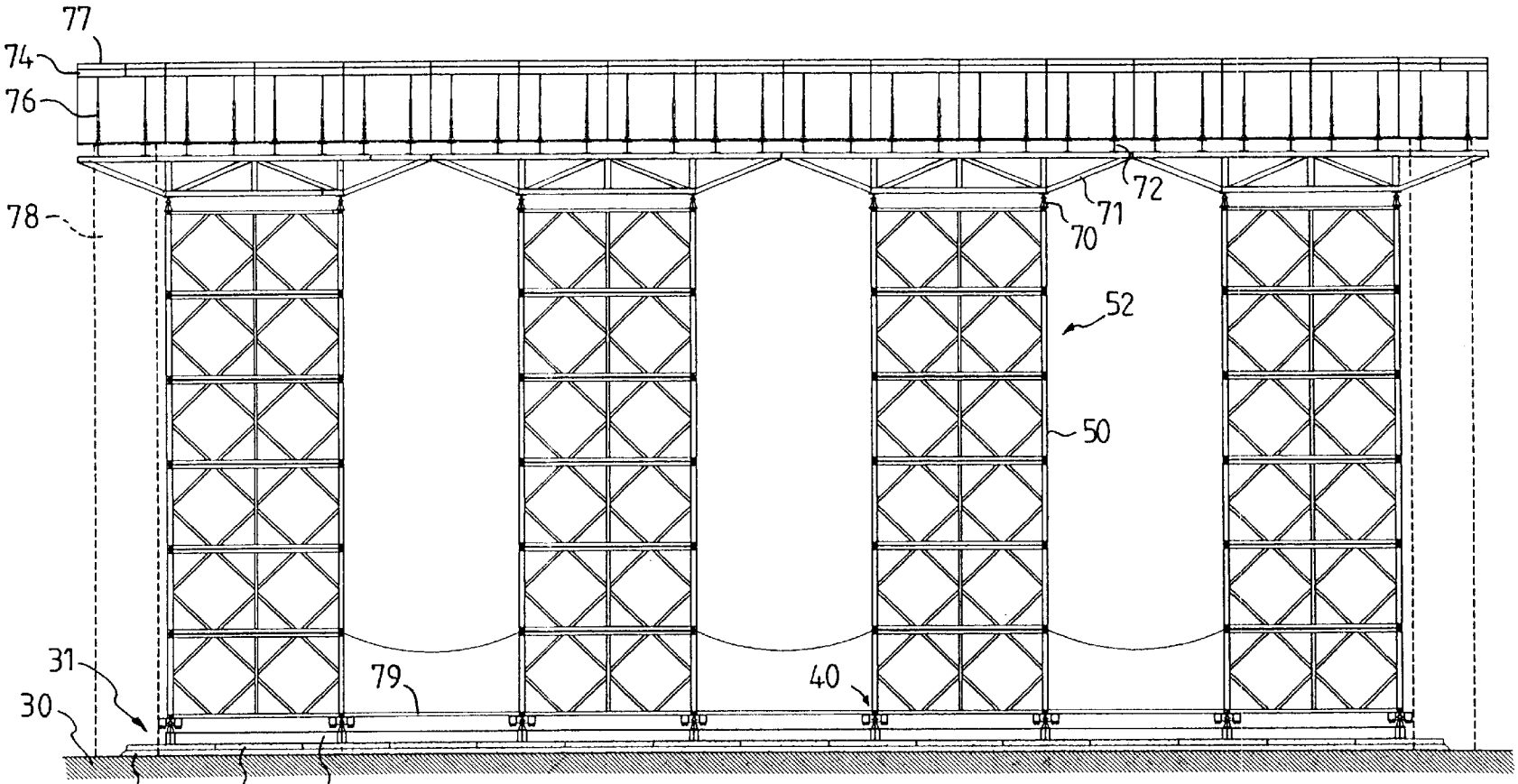
FIG. 7 is a schematic side view of the ground advance shoring system according to this invention.
Figure 8:
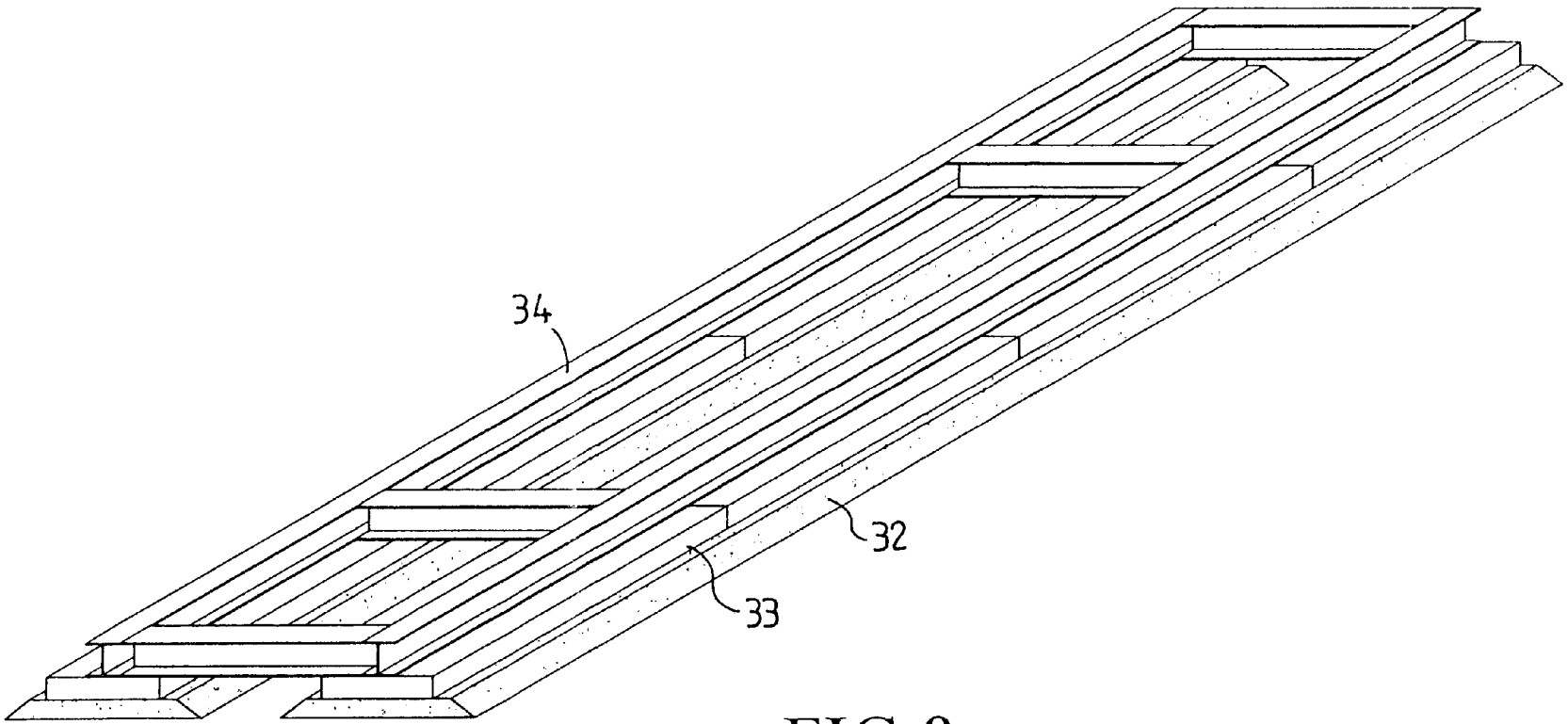
FIG. 8 is a schematic three-dimensional view of the railway assembly of this invention.
Figure 9:
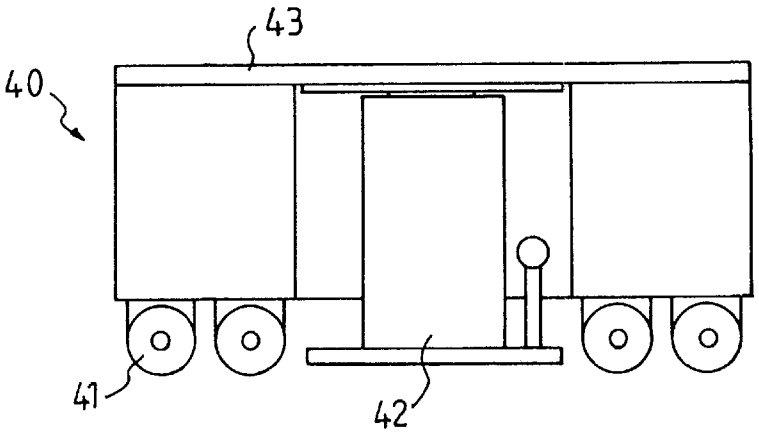
FIGS. 9–11 illustrate the movable device according to this invention, wherein the bottom jacks shown in FIGS. 9 and 10 are at releasing status, while the bottom jacks shown in FIG. 11 are at lifting status.
Figure 10:
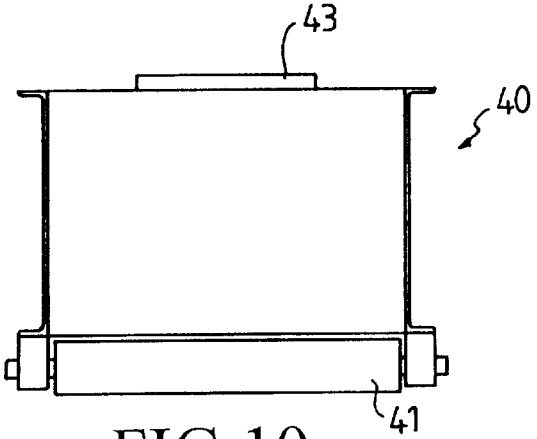
Figure 11:
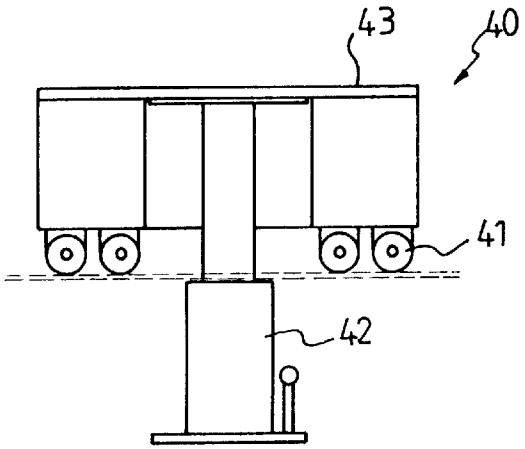

This invention is related to a ground advance shoring system and the construction method using such a system. Detailed description of the preferred embodiments according to this invention is provided in association with the drawings. The system according to this invention, as illustrated in FIGS. 6 and 7, generally comprises a railway assembly 31 which is provided on the ground 30. The railway assembly 31, as shown in FIG. 8, includes aggregate 32, such as gravel, paved on the ground 30, lining plates 33 covered on the aggregate 32, and railways 34 placed on the lining plates 33. In the preferred embodiment of this invention, the railways 34 are constructed by longitudinal and traverse steel H-beams. The system according to this invention further comprises at least one movable device 40, as shown in FIGS. 9–11, which includes a moving platform 43 and. can be moved on the railway assembly 31. In the preferred embodiment of this invention, a plurality of wheels 41 and at least one bottom jack 42, which can be altered between a lifting status (as shown in FIG. 11) and a releasing status (as shown in FIG. 9), is provided at the bottom of the movable device 40. When the moving platform 43 is lifted by the bottom jacks 42, the movable device 40 is lifted and separated from the railways 34, as illustrated in FIGS. 6 and 7, such that the movable device 40 is in connection with the railways 34 through the bottom jacks 42 only and thus cannot be moved. When the bottom jacks 42 under the moving platform 43 are released, as shown in FIG. 9, the movable device 40 engages with the railways 34 directly and can be moved thereon by the wheels 41. In the preferred embodiment of this invention, the movable device 40 can be driven by an electric motor, winch (not shown) or even manually.

Figure 12:
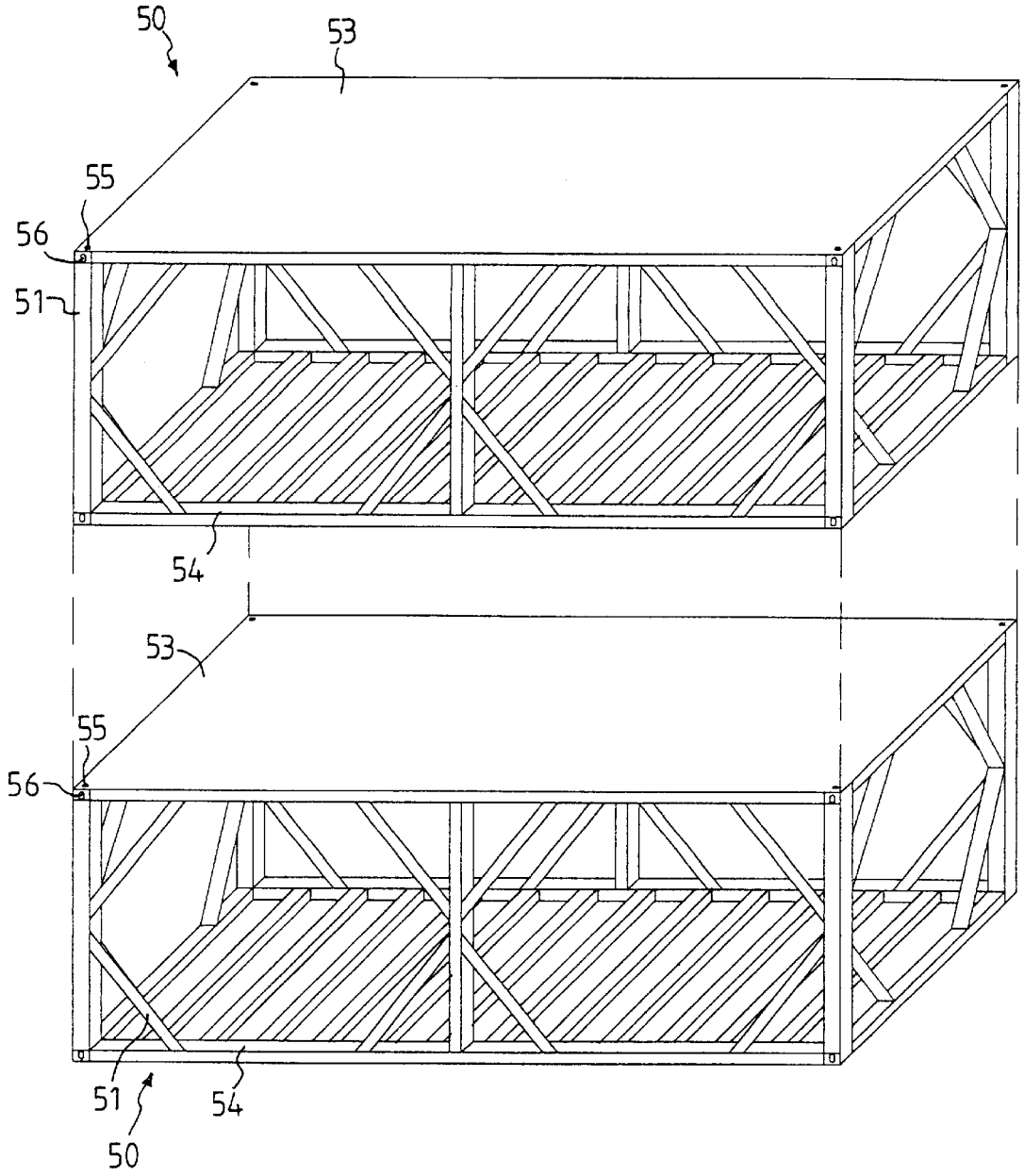
FIG. 12 is a schematic three-dimensional view of the framework supporting unit according to this invention.

The system of this invention further comprises a plurality of framework supporting units 50, as shown in FIG. 12, which are rectangular parallelepiped supporting framework constructed by a plurality of steel frames 51. The framework supporting units 50 are vertically stacked and assembled together on the movable device 40 to form a supporting tower 52, as illustrated in FIGS. 6 and 7. In the preferred embodiment of the invention, the supporting towers 52 are arranged in two rows, four towers 52 for each row, in a span of 45 meters long. The supporting strength of the framework supporting unit 50 is provided by the connected steel frames 51. The top side 53 and/or bottom side 54 of the framework supporting unit 50 is covered by metal sheets or several steel frames, but the lateral sides of the framework supporting unit 50 are left open, as shown in FIG. 12, so as to reduce the impact on the stability of the invention caused by wind.

Figure 13:
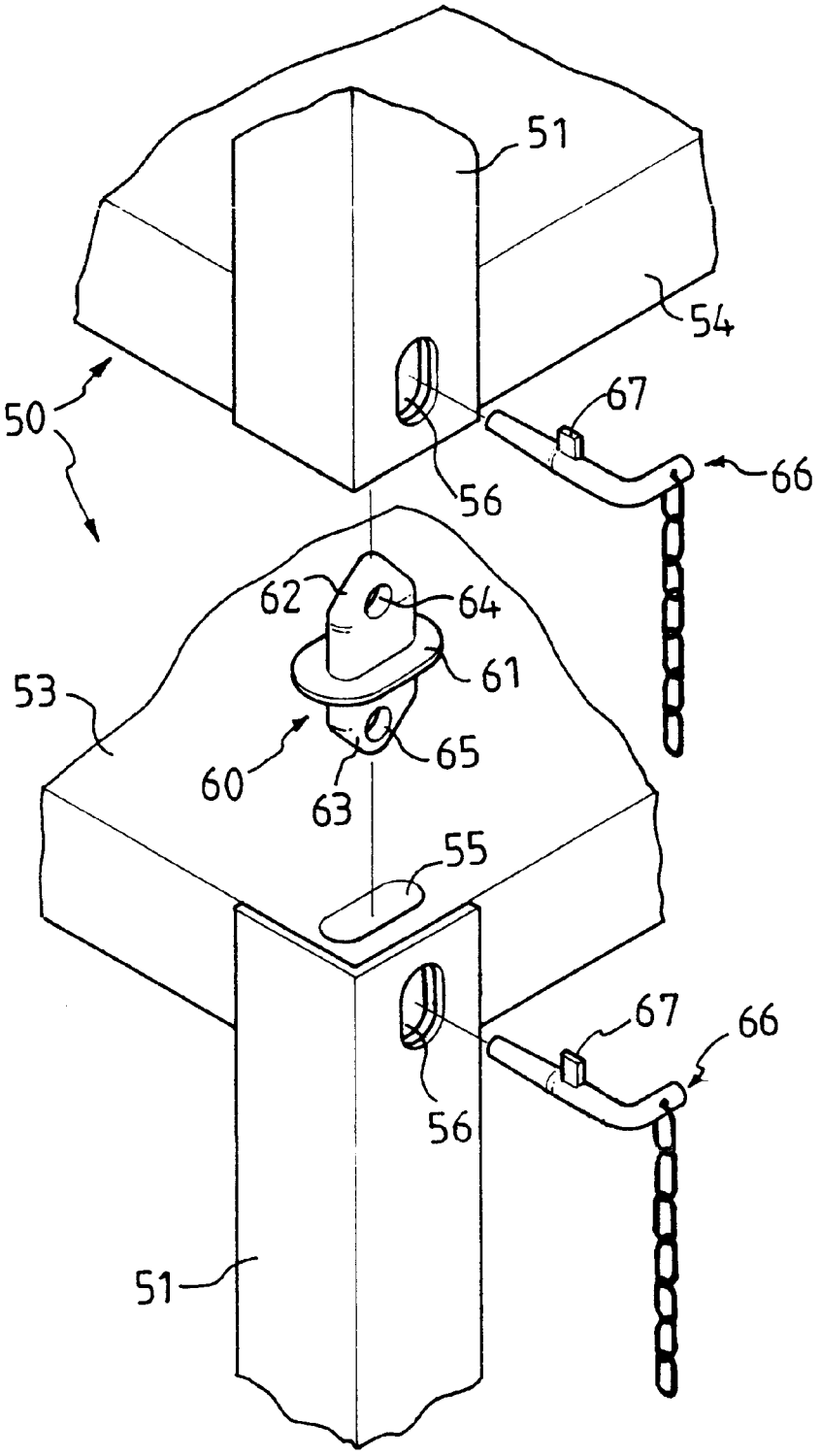
FIG. 13 is an enlarged schematic view illustrating the connection of the framework supporting units by locking blocks and latches according to this invention.

The corners of the top side 53 and the bottom side 54 of each of the framework supporting units 50 are provided with elongated holes 55, as shown in FIG. 13 (only one of the holes 55 is illustrated), and lateral holes 56 are provided on the lateral sides of the corners. As shown in FIGS. 6 and 7, the framework supporting units 50 are vertically stacked one by one. During the assembly, a locking block 60 is placed into the elongated hole 55 at the top of the bottom framework supporting unit 50. As illustrated in the enlarged view of FIG. 13, the locking block 60 has a central plate 61 with an upward protrusion 62 and a downward protrusion 63 extended from the top and bottom sides of the central plate 61, respectively. The upward protrusion 62 and the downward protrusion 63 have round holes 64 and 65, respectively. The area of the central plate 61 is larger than the area of the elongated holes 55 at the top or bottom sides of the framework supporting unit 50. Therefore, when the locking block 60 is placed on the framework supporting unit 50, the central plate 61 leans against the top side 53 of the bottom framework supporting unit 50, and only the downward protrusion 63 will be inserted into the elongated holes 55. Another framework supporting unit 50 is then placed on top of the bottom framework supporting unit 50, such that the upward protrusions 62 of the locking blocks 60 are aimed and inserted into the elongated holes 55 at the bottom of the framework supporting unit 50 on top. Latches 66 thereafter are inserted into the lateral holes 56 of the framework supporting units 50 at the top and the bottom, respectively, as well as the round holes 64 and 65 of the locking block 60, as can be seen in FIG. 13. The diameter of the latch 66 is sized to be fitted into the round holes 64 and 65 of the locking block 60. A sheet protrusion 67 is provided at approximately the middle region of the latch 66. Since the lateral hole 56 of the framework supporting unit 50 is substantially in the shape of a long ellipse, and the round holes 64 and 65 of the locking block 60 are circular, the sheet protrusion 67 can only pass through the lateral hole 56 of the framework supporting unit 50 but not the round holes 64 and 65 of the locking block 60 during the insertion of the latch 66. After the insertion of the latch 66, it is rotated clockwise or counterclockwise for about 90 degrees such that the sheet protrusion 67 of the latch 66 becomes horizontally laid between the outer steel frame 51 of the framework supporting unit 50 and the locking block 60. Accordingly, the free end of the sheet protrusion 67 laterally exceeds the edge of the lateral hole 56, the sheet protrusion 67 thus cannot be pulled out directly. The two framework supporting units 50 are therefore locked together.

Figure 14:
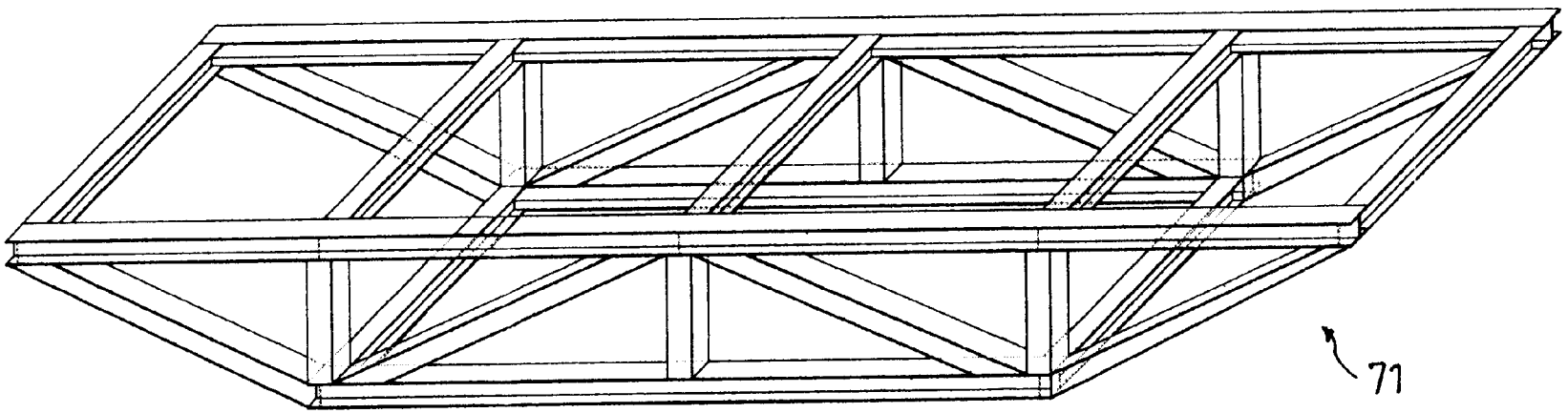
FIG. 14 is a schematic three-dimensional view of the mold supporting frame according to this invention.
Figure 15:
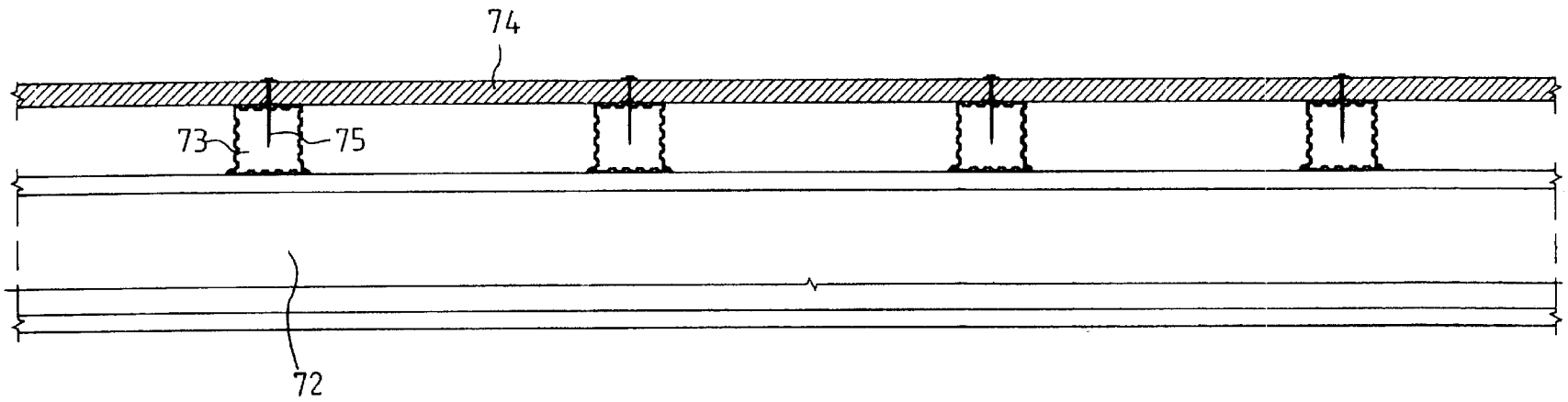
FIG. 15 is an enlarged schematic view showing the installation measures of the mold plates.

The system according to this invention further comprises a plurality of top jacks 70 being provided on top of the supporting tower 52. In the preferred embodiment of this invention, as illustrated in FIGS. 6 and 7, four top jacks 70 are installed around the corners of each supporting tower 52. A mold supporting frame 71, as shown in FIG. 14, is provided on the top jacks 70 which are used for adjustments of longitudinal and traverse gradients of the mold supporting frame 71. Furthermore, a plurality of traverse steel H-beams 72 are placed on the mold supporting frame 71; back supporting materials 73, as shown in FIG. 15, are welded on the traverse steel H-beams 72; and mold plates 74 are assembled with the back supporting materials 73 by screws 75. The mold plates 74 may be further supported by inclined struts 76, as illustrated in FIGS. 6 and 7, such that the mold plates 74 are erected for the subsequent casting of bridge concrete 77.

Figure 7A:
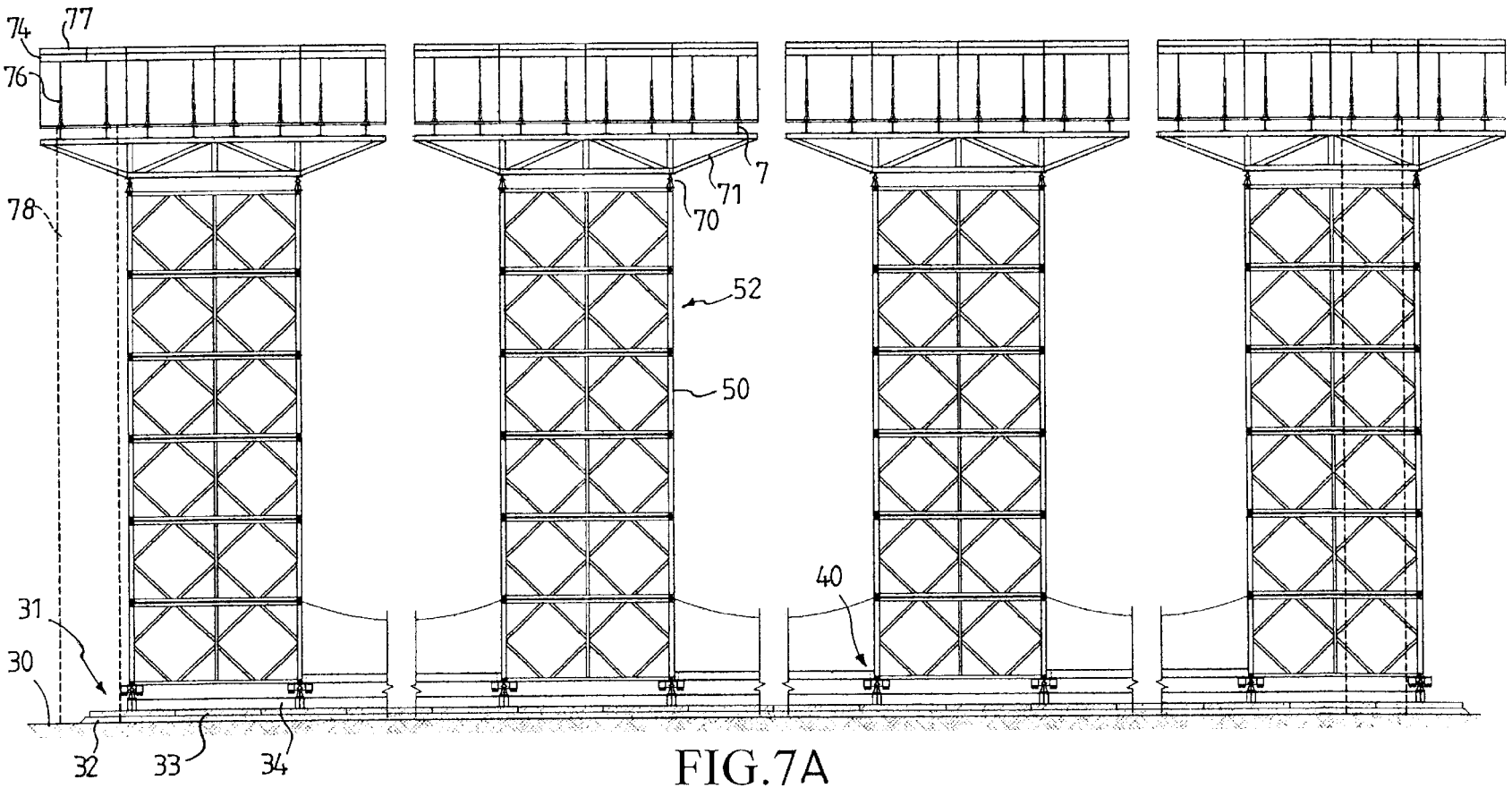
FIG. 7A is a schematic side view of the ground advance shoring system according to this invention, in which each of the supporting towers is separated for individual movement.

The ground advance shoring construction method according to this invention generally comprises the steps as follows. Firstly, the constructor utilizes bulldozers and/or other machinery to level the ground 30. Aggregate 32 is then paved on the ground 30 and leveled by the bulldozers as well. Lining plates 33 are covered on the aggregate 32, and then railways 34 are placed on the lining plates 33. Movable devices 40 are provided on the railways 34 and can be moved thereon. When the movable devices 40 are moved to designated positions, the bottom jacks 42, as shown in FIG. 11, are used to lift the moving platforms 43 and secure the movable devices 40. The framework supporting units 50 are vertically stacked and assembled together on the movable device 40 to form a supporting tower 52. A plurality of top jacks 70, as shown in FIG. 7, are provided on top of the supporting tower 52, and a mold supporting frame 71 is provided on the top jacks 70 which are used for adjustments of longitudinal and traverse gradients of the mold supporting frame 71. Traverse steel H-beams 72 are then placed on the mold supporting frame 71, back supporting materials 73, as shown in FIG. 15, are welded on the traverse steel H-beams 72, and mold plates 74 are assembled with the back supporting materials 73 by screws 75 or welding. The mold plates 74 are thus erected for the subsequent casting of bridge concrete 77. After the bridge concrete 77 has cured, the mold plates 74 are lowered, separated from the bridge concrete 77, and moved slightly, if necessary, so that the mold plates 74 can elude the casted concrete posts 78 during the movement of the supporting towers 52. The bottom jacks 42 are thereafter released and thus the movable devices 40 resume contact with the railways 34. The movable devices 40 and the supporting towers 52 thereon are then moved to designated positions for the next span. The four supporting towers 52 can be separated and individually moved, as illustrated in FIG. 7A, by electric motor, winch or manually. Alternatively, as shown in FIG. 7, the four supporting towers 52 in a row can be further connected by lower frames 79 such that the complete row of the four supporting towers 52 can be moved to the next span at once by electric motor or winch.

After the supporting towers 52 are moved to the desired locations, the bottom jacks 42 are again used to lift and secure the movable devices 40 and the supporting towers 52 thereon. The subsequent steps, such as erecting the mold plates 74 for casting the bridge concrete 77, are repeated thereafter.

After the bridge concrete 77 has been casted and cured for each span, and prior to the movement of the movable devices 40 to the next span, the steps of conditioning the ground 30, paving the aggregate 32 on the ground 30, leveling the aggregate 32, covering the lining plates 33 on the aggregate 32, and placing the railways 34 on the lining plates 33 should be repeated first in the direction to be moved for the next span. The movable devices 40, thus, can be moved on the railways 34 to the next span for continuous construction of the bridge.

A specific embodiment of this invention is described hereafter for the comparison of the techniques between this invention and the conventional stationary shoring construction method such that the advantages of this invention can be clearly demonstrated.

Comparison of Craning and Assembly of Supporting Frames

Figure 1:
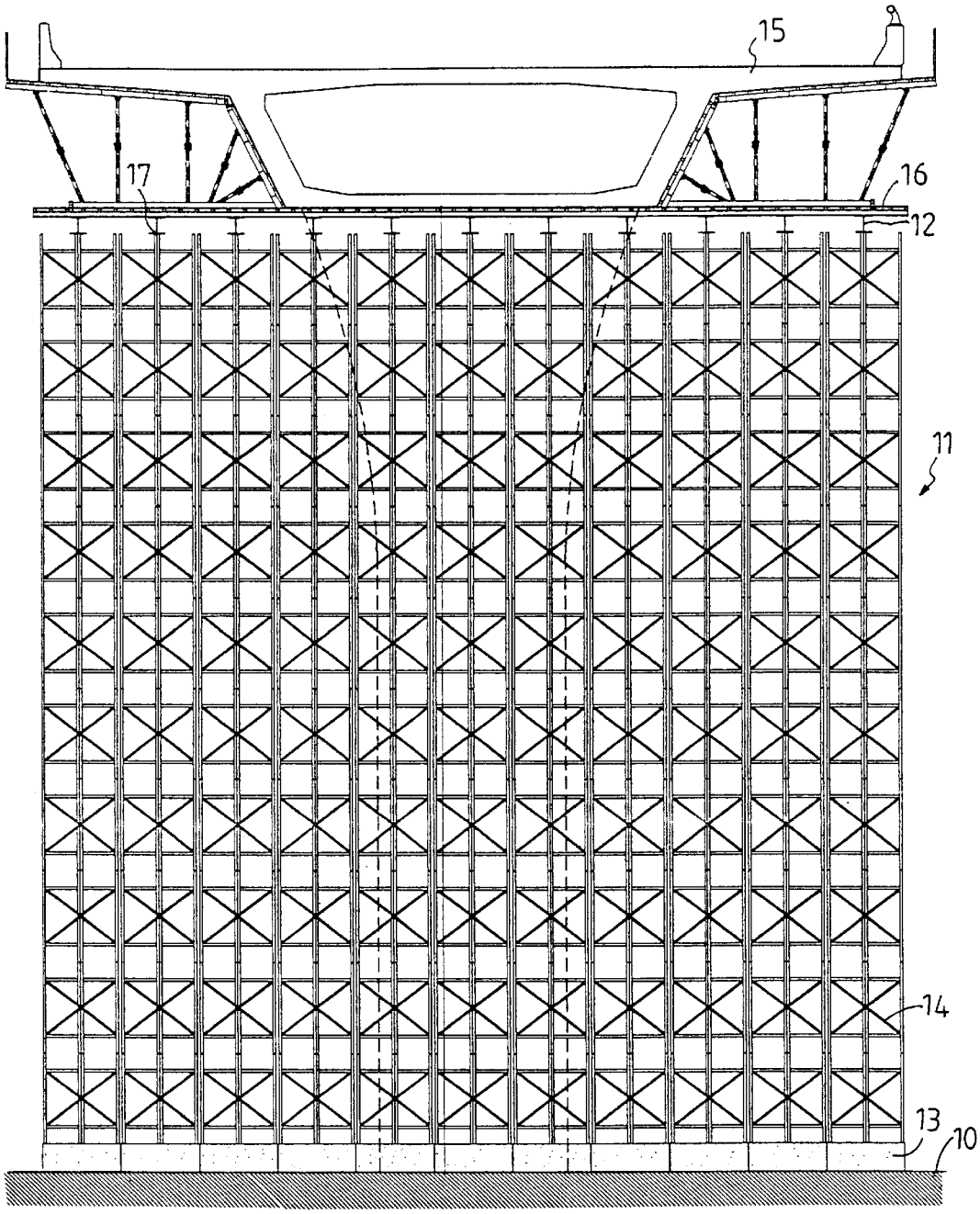
FIG.1 (PRIOR ART)
FIGS. 1 and 2 are schematic views of the installed supporting frames used in the conventional stationary shoring construction method.
Figure 2:
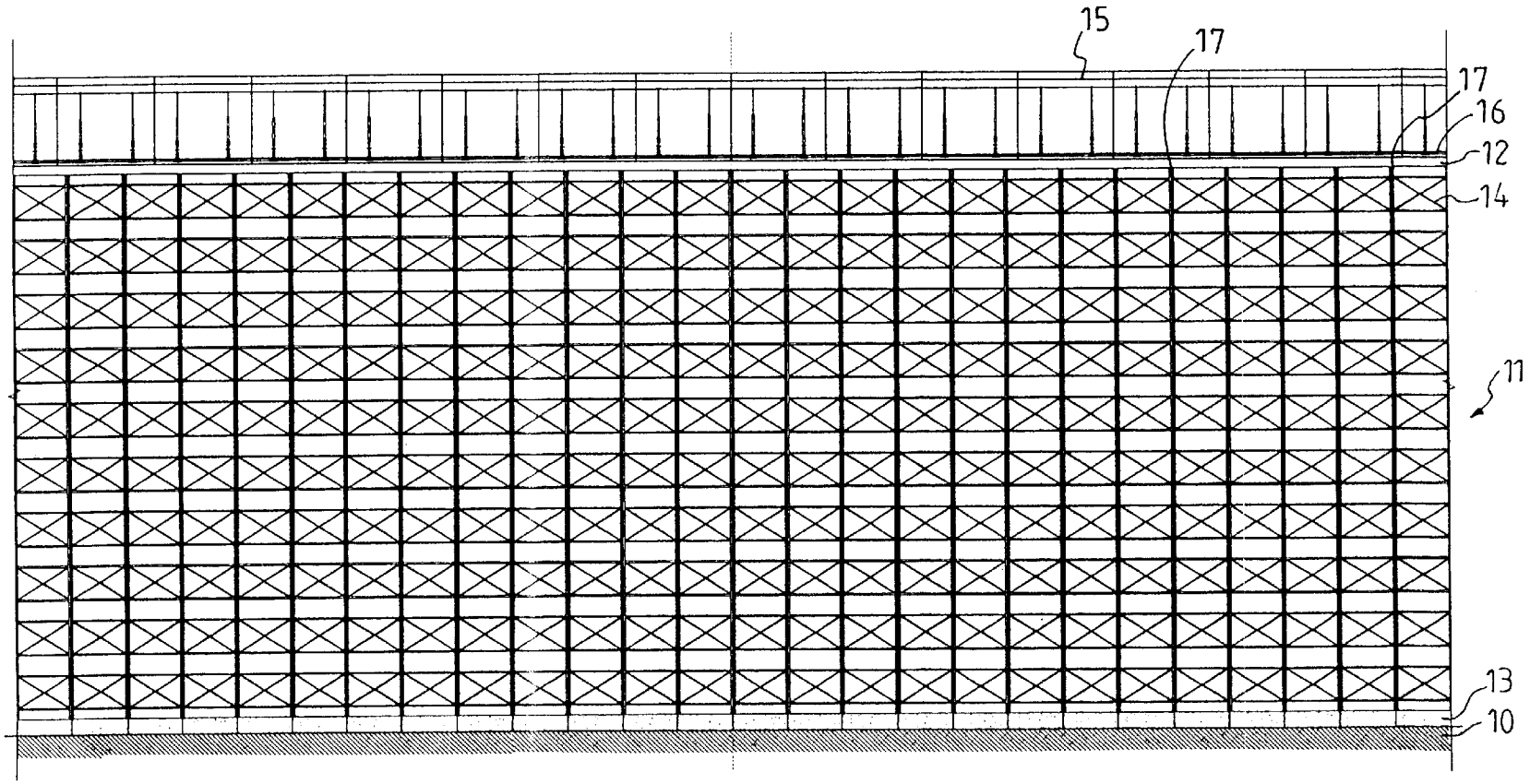
FIG.2 (PRIOR ART)
Figure 3:
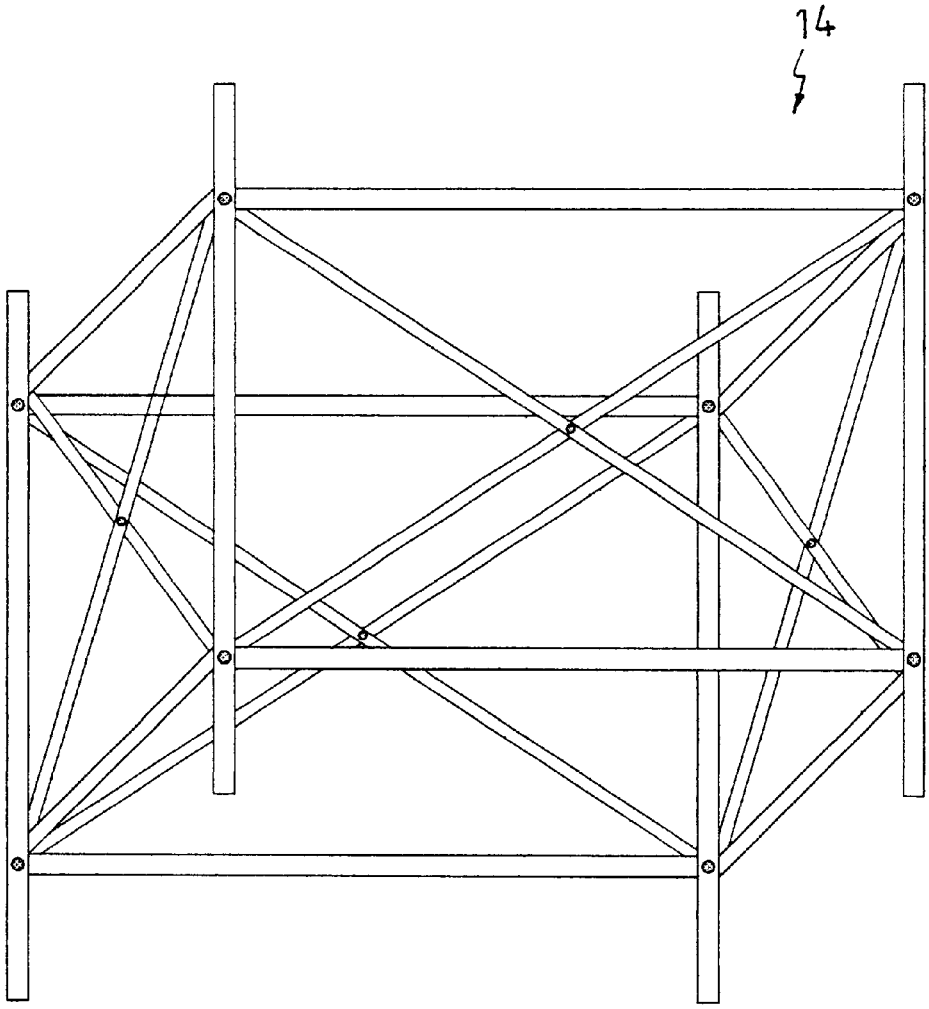
FIG.3 (PRIOR ART)
FIG. 3 is a schematic view of the supporting frame unit used in the conventional stationary shoring construction method.
Figure 4:
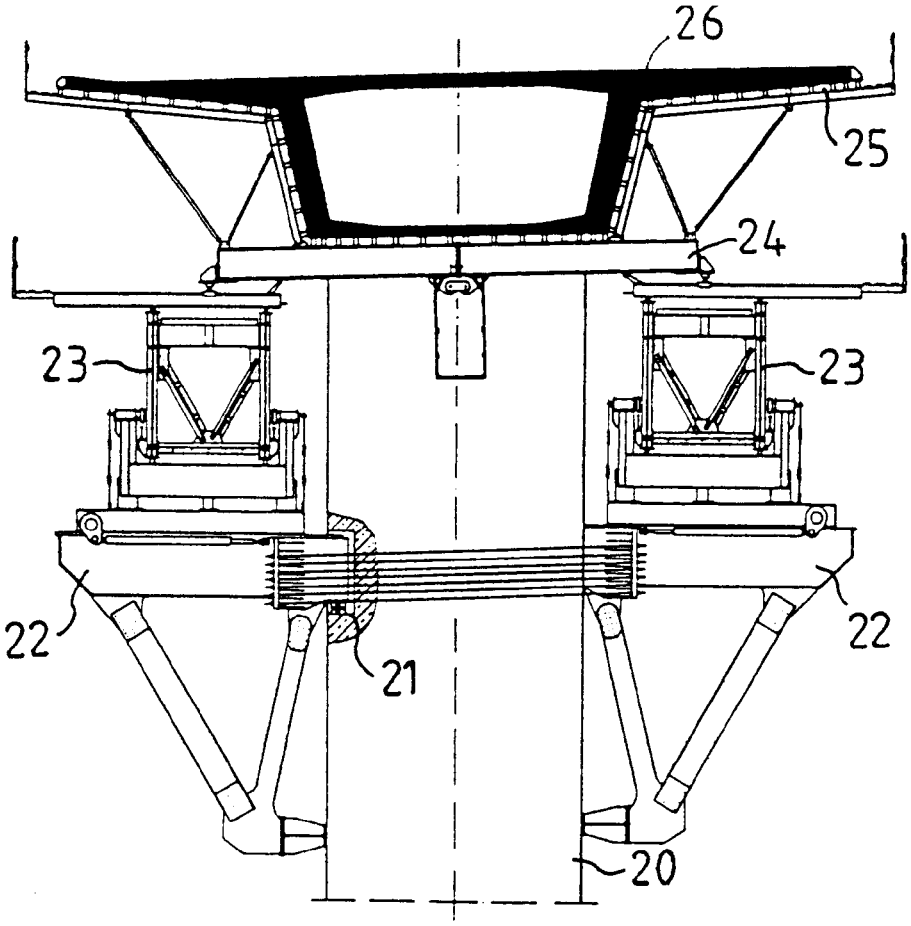
FIG.4 (PRIOR ART)
FIG. 4 is a schematic cross-sectional view of the major constructional elements of the conventional advancing shoring system.
Figure 5:
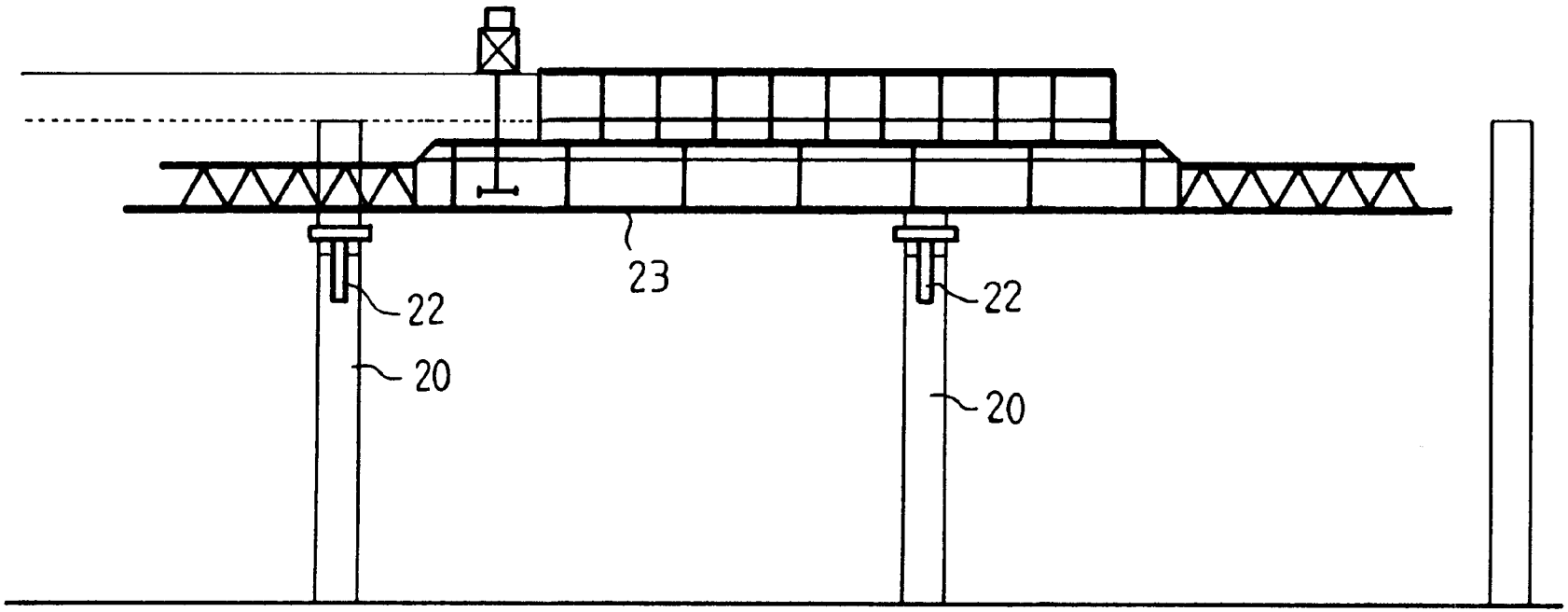
FIG.5 (PRIOR ART)
FIG. 5 is a schematic view showing the overall appearance of the conventional advancing shoring system.

Assuming each span of the bridge to be constructed is 45 meters long, 16 meters wide and 18 meters high. The typical conventional supporting frame unit 14, as shown in FIG. 3, is approximately 1.7 meter long, 0.7 meter wide and 1.7 meter high. For the length of 45 meters, at one supporting frame unit 14 per 1.7 meter, around 26 supporting frame units 14 are required; for the width of 16 meters, one supporting frame unit 14 per 0.7 meter, 22 rows thereof are needed; for the height of 18 meters, one supporting frame unit 14 per 1.7 meter, then 10 layers thereof are needed. Accordingly, the conventional stationary shoring construction method requires:

26×22×10=5720 (pieces of supporting frame unit);

The installed supporting frames 11 are generally illustrated in FIGS. 1 and 2. If two supporting frame units 14 are combined as a set of supporting frames, then 2860 sets of supporting frames are required. Different sets of the supporting frames are usually connected by screws and connection rods (not shown) by two workers in about five minutes. Therefore, connecting 2860 sets of supporting frames will spend 14300 minutes, i.e., about 238 hours. If a team of two workers works eight hours per day, thirty days is necessary for completing the installation of the whole supporting frames 11 for the team. If the installation of the supporting frames 11 needs to be completed in six days, then five teams, i.e., ten workers should work simultaneously. During the installation of the supporting frames 11, a crane truck is also required for craning each set of the supporting frames to a desired position. Similarly, assuming a team of two workers is employed for the craning operation, the average time for craning each set of the supporting frames is around five minutes, the time for craning 2860 sets of supporting frames will also be about 238 hours, that is, thirty days for the team of two workers and the crane truck. Again, if the installation of the supporting frames 11 needs to be completed in six days, then five teams, i.e., ten workers and five crane trucks should be employed. The above descriptions can be summarized in the table below.

| | assembly | craning | total |
|---|---|---|---|
| sets of supporting frames | 2860 sets | 2860 sets | 5720 sets |
| time required | 238 hours | 238 hours | 476 hours |
| time needed for a team working 8 hours per day | 30 team-days | 30 team-days and 30 crane truck-days | 60 team-days and 30 crane truck-days |
| people-day required for a team of 2 workers | 60 people-days | 60 people-days | 120 people-days and 30 crane truck-days |
| manpower and apparatus for completing the installation within 6 days | 10 people/day for 6 days | 10 people/day for 6 days | 20 people/day for 6 days and 5 crane trucks for 6 days |

With respect to this invention, the framework supporting units 50, as illustrated in FIG. 12, are welded in the factory and directly shipped to the worksite. The dimension of the framework supporting unit 50 is around 6.058 meters long, 2.438 meters wide, and 2.85 meters high. For the same dimension of each span of the bridge to be constructed, i.e., 45 meters long, 16 meters wide and 18 meters high, as illustrated in FIGS. 6 and 7, for the length of 45 meters, at one framework supporting unit 50 per 12 meters (6 meters between two framework supporting units 50), around four framework supporting units 50 are required; for the width of 16 meters, only two rows thereof are needed; for the height of 18 meters, at one supporting frame unit 50 per 2.85 meters, then 6 layers thereof are needed. Thus, the total number of required framework supporting units 50 will be:

4×2×6=48 (supporting frame units);

The time for craning each framework supporting unit 50 will require approximately ten minutes. The framework supporting units 50 are assembled by the locking blocks 60 and the latches 66, as shown in FIG. 13, which requires a very short period of time and therefore can be inclusively considered in the above ten minutes. Accordingly, the time for craning these 48 framework supporting units 50 is around 480 minutes, i.e., 8 hours, which can be completed within one day. Because the dimension of the framework supporting unit 50 of this invention is significantly larger than a conventional supporting facility, the craning operation thereof is preferred to be operated by a team of four workers. Thus, the craning and assembly of the supporting frames of this invention will require only four people-days and one crane truck-day. Obviously, this invention significantly reduces the manpower and working time required for the installation of the supporting facility.

Comparison of Removal of Basic Lining Under Supporting Frames

The conventional stationary shoring construction method includes ground conditioning and pavement of gravel thereon. Movable or fixed concrete blocks 13, as illustrated in FIGS. 1 and 2, are then placed on the gravel, such that the weight of the bridge concrete 15 can be evenly distributed on the ground 10. For the stationary concrete blocks 13, they need to be demolished and shipped away after the completion of the construction. This will result in a considerable waste of concrete and require additional manpower, materials and construction time. For the movable concrete blocks 13, heavy machinery for moving them will be necessary. If each of the conventional supporting frame units 14 has four supporting points on one concrete block 13, then 26×22=572 (supporting points);

572÷4=143 (pieces of concrete block);

The time for placing and dismantling of one concrete block will require approximately three minutes. The total time for moving all those 143 pieces of concrete blocks will need 858 minutes, i.e., around 14.3 hours.

The ground conditioning work of this invention is similar to that performed in the conventional stationary shoring construction method. Nevertheless, the framework supporting units 50 of this invention are provided on the movable devices 40 which are placed on the railways 34 made of steel H-beams. Lining plates 33, as shown in FIG. 8, are provided under the railways 34, and aggregate 32 is paved below the lining plates 33. Prior to the movement of the supporting towers 52 of this invention to the next span, the aggregate 32 needs to be paved first in the moving direction. Each section of the steel H-beams used for the railways 34 has a length of about 12 meters and a width of about 2.5 meters. Two rows of railways 34 are paved for the span of 45 meters, four sections for each row, thus, eight sections of the railways 34 are required. Assuming each of the lining plates 33 utilized is 3 meters long and 1 meter wide, two rows of the lining plates 33 are required below each section of the railways 34. Therefore, for the span of 45 meters, four sections of lining plates 33, i.e., 64 pieces of the lining plates 33 is required. The time for hanging up and down of one section of railway is approximately 10 minutes, and the time for hanging each piece of the lining plate is about 6 minutes, therefore, the total time for moving the railways and the lining plates to the next span of this invention will require:

10×8+6×64=464 (minutes), about 8 hours;

Furthermore, the time for moving, paving and leveling of the aggregate 32 is about 2 hours. Thus, the total time for setting up the railway assembly 31 of this invention is around 10 hours, which is 4.3 hours less than the 14.3 hours required for placing the concrete blocks only in the conventional stationary shoring construction method.

Comparison of Leveling

As illustrated in FIGS. 1 and 2, the conventional stationary shoring system includes 26×22=572 supporting points 17 within the span of 45 meters. Prior to placing the steel H-beams, wooden corners and mold plates on the supporting frame 11, each of the supporting points 17 needs to be leveled. If every two pieces of the supporting frame units 14 are considered as one set of supporting frames, then there are 286 sets of supporting frames that need to be leveled. If the average time for adjusting one set of supporting frames is two minutes, then 572 minutes, i.e., 9.5 hours are required.

This invention utilizes two rows, four supporting towers 52 per row, i.e., total of eight supporting towers 52 for the span of 45 meters, as illustrated in FIGS. 6 and 7. Large mold supporting frames 71 are further provided on the supporting towers 52 and four top jacks 70 are provided on each supporting tower 52 and below the mold supporting frame 71 for adjustments of longitudinal and traverse gradients thereof so as to ensure the mold plates 74 thereon are leveled or the gradients thereof meet the desired conditions. Accordingly, there are 32 top jacks 70 on top of the eight supporting towers 52 needing to be adjusted. The average time for adjusting each of the top jacks 70 is approximately three minutes, the total time for leveling requires 96 minutes, i.e., around 1.5 hours. As a result, this invention dramatically subtracts about 8 hours from the 9.5 hours required for leveling in the conventional stationary shoring construction method.

Comparison of Moving Supporting Frames to Next Span

As described in the background of the invention, crane truck(s) is/are required to remove the series of the supporting frames outside in for the conventional stationary shoring construction method to dismantle the supporting frames. Each series of the supporting frames is tilted and put on a truck by the crane and is moved to the next span for subsequent construction process. If the supporting frame is too high, the usual crane truck would not be able to reach the height thereof. Accordingly, a heavy crane truck will be necessary which results in additional costs, machinery and manpower along with increased difficulty in operation.

On the other hand, there is no need to dismantle the supporting towers 52 utilized in this invention after the casting of the concrete bridge 77. The constructors only need to pave the railway assembly 31 in the position of the next span in advance, the movable devices 40 and the supporting towers 52 thereon thus can be moved directly to the next span by electric motor or winch (not shown). The movement of the movable devices 40 and the supporting towers 52 thereon is similar to the movement of two trains. If the average advancing speed of the supporting towers is 3 m/min, the time for moving one supporting tower for 45 meters to the next span is around 15 minutes. If the eight supporting towers are moved one by one, as shown in FIG. 7A, the total time for moving them will be about 120 minutes, i.e., two hours. Alternatively, as illustrated in FIG. 7, the four supporting towers 52 in a row can be further connected by lower frames 79 which can be formed by steel H-beams and thus, the four supporting towers 52 in a row can be moved to the next span at once by electric motor or winch. If the complete row of the supporting towers 52 is moved at the same speed, i.e., 3 m/min, the total time for moving the two rows of the supporting towers 52 will be 30 minutes only. Obviously, this invention saves time, manpower, costs and machinery for dismantling and re-assembly of the supporting frames.

Comparison of Amount of Supporting Facilities

As described above, the dismantling and assembly of the supporting frames for the conventional stationary shoring system will take about one week. To have construction progress smoothly, the constructors usually prepare at least two complete sets of the supporting facilities and the mold plates. Therefore, during the strapping of the reinforced steel and the casting of concrete for the odd span, for example, the constructors can at the same time assemble the supporting frames and the mold plates for the next span, i.e., the even span. After the casting of the concrete for the odd span being completed, the strapping of the reinforced steels and the casting of the concrete can be continuously conducted for the even span, and the supporting frames and the mold plates for the odd span can be dismantled and moved to the next odd span for assembly at the same time. Accordingly, the conventional stationary shoring construction method requires at least two sets of the supporting facilities.

The supporting towers 52 and the mold plates 74 of this invention can be moved to the next span within several hours by the movable devices 40 on the railways 34, thus, the supporting towers 52 do not need to be dismantled repeatedly. As a result, this invention does not require another set of the supporting frames and the mold plates to be pre-assembled at the next span. This invention only requires an additional set of the railway assembly 31, including the aggregate 32, the lining plates 33 and the railways 34, which will be paved in advance at the location of the next span. Accordingly, this invention saves the funds, interests, depreciation, operation, as well as storage of the whole set of the supporting frames.

Comparison of Dispersive Mold Plates and Systematic Mold Plates

As described above, the conventional stationary shoring construction method involves hundreds of the supporting points 17, as shown in FIGS. 1 and 2, while the heights of the concrete blocks 13 under the supporting frames 11 can hardly be kept unchanged. Thus, it is necessary to adjust the level and position of the supporting points 17 one by one for subsequent installation of the steel H-beams, wooden corners and mold plates etc. The adjustment of every supporting point 17 will consume a lot of time. In addition, the conventional stationary supporting construction method needs to use the traditional dispersive mold plates as well as install and adjust them piece by piece. After completing the casting of the concrete, the dispersive mold plates need to be dismantled piece by piece again and thus, it is very time consuming.

The number of the supporting points according to this invention is considerably reduced and the top of the supporting tower 52 is provided with the mold supporting frame 71 and the lower frames 79 which are firmly formed by steel H-beams with definite dimensions, as illustrated in FIGS. 6 and 7. Therefore, the positioning of the mold plates of this invention can be easily done in a short time. Furthermore, systematic mold plates can be used in this invention. That is, after completing the casting of the bridge concrete 77, there is no need to dismantle the mold plates 74 of this invention piece by piece as in the conventional method. The mold plates 74 of this invention only need to be loosened and lowered to a certain position under the bridge concrete 77 and moved slightly by the mold supporting frame 71 (such a status is not shown in the drawings), so that the mold plates 74 of this invention can elude the casted concrete posts 78 during the movement of the supporting towers 52 to the next span by the movable devices 40. Therefore, the utilization of the systematic mold plates in this invention considerably reduces time and manpower in comparison with the conventional stationary shoring construction method.

This invention is related to a novel construction method and device that make a breakthrough in conventional art. Aforementioned explanations, however, are directed to the description of preferred embodiments according to this invention. Various changes and implementations can be made by those skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

List of Reference Numerals

| | |
|---|---|
| 10 | ground |
| 11 | supporting frames |
| 12 | steel H-beams |
| 13 | concrete blocks |
| 14 | supporting frame units |
| 15 | bridge concrete |
| 16 | molding plates |
| 17 | supporting points |
| 20 | concrete post |
| 21 | recess |
| 22 | bracket |
| 23 | truss |
| 24 | steel H-beams |
| 25 | molding plates |
| 26 | bridge concrete |
| 30 | ground |
| 31 | railway assembly |
| 32 | aggregate |
| 33 | lining plates |
| 34 | railways |
| 40 | movable device |
| 41 | wheels |
| 42 | bottom jacks |
| 43 | moving platform |
| 50 | framework supporting units |
| 51 | steel frames |
| 52 | supporting towers |
| 53 | top side of the framework supporting unit |
| 54 | bottom side of the framework supporting unit |
| 55 | elongated holes |
| 56 | lateral holes |
| 60 | locking block |
| 61 | central plate |
| 62 | upward protrusion |
| 63 | downward protrusion |
| 64 | round hole |
| 65 | round hole |
| 66 | latch |
| 67 | sheet protrusion |
| 70 | top jacks |
| 71 | mold supporting frame |
| 72 | traverse steel H-beams |
| 73 | back supporting materials |
| 74 | mold plates |
| 75 | screws |
| 76 | inclined struts |
| 77 | bridge concrete |
| 78 | concrete posts |
| 79 | lower frames |

What is claimed is:

1. A method of constructing a ground advance shoring system, comprising steps of:

(a) paving and leveling aggregate on a generally conditioned ground;

(b) covering a plurality of lining plates on the aggregate;

(c) paving at least one railway on the lining plates;

(d) locating at least one movable device on the at least one railway, in which the at least one movable device includes a moving platform and a bottom jack provided below the moving platform so that the moving platform is lifted away from the at least one railway and supported by the bottom jack when the at least one movable device is moved to a designated position;

(e) vertically stacking and securely locking a plurality of framework supporting units on the at least one movable device to form a supporting tower;

(f) locating a top jack assembly on the supporting tower and then locating a mold supporting frame on the top jack assembly, in which the top jack assembly is provided for adjusting longitudinal and transverse gradients of the mold supporting frame; and (g) setting up a mold plate assembly on the mold supporting frame.

2. The method as set forth in claim 1, wherein the step (c) includes paving two parallel railways and the step (d) includes locating eight movable devices on the two railways, and four of the movable devices are spaced apart on one of the railways and the other four movable devices are spaced apart on the other railway in an opposing manner, thereby stacking the framework supporting units on the movable devices forms eight supporting towers.

3. The method as set forth in claim 2, wherein the step (f) includes respectively locating eight top jack assemblies and eight mold supporting frames on the eight supporting towers, and wherein the step (g) includes setting up the mold plate assembly which substantially extends throughout an area defined by the eight supporting frames.

4. The method as set forth in claim 3, wherein the step (c) includes paving two sufficiently long parallel railways to provide the eight movable devices of the step (d) to subsequently move to next designated positions.

5. The method as set forth in claim 4, wherein each of the eight movable devices is moved individually.

6. The method as set forth in claim 4, wherein each row of the four movable devices are connected by lower frames so that each row of the four movable devices is moved at once.

7. The method as set forth in claim 2, wherein each of the railways is substantially constructed by steel H-beams.

8. The method as set forth in claim 1, wherein each of the framework supporting units is a rectangular parallelepiped supporting framework constructed by a plurality of steel frames.

9. The method as set forth in claim 1, wherein the stacked framework supporting units are locked by a plurality of locking blocks and latches.

10. The method as set forth in claim 1, wherein the mold supporting frame is constructed by a plurality of steel H-beams.

11. A ground advance shoring system, comprising:

a railway assembly for being set up on a ground;

at least one movable device disposed on the railway assembly for moving thereon, in which the at least one movable device includes a moving platform and a bottom jack provided below the moving platform for lifting and releasing the moving platform; when the bottom jack lifts the moving platform, the at least one movable device is separated from the railway assembly and unable to move along the railway assembly, whereas when the bottom jack releases the moving platform, the at least one movable device engages the railway assembly for moving thereon;

a plurality of framework supporting units being vertically stacked on the at least one movable device to form a supporting tower; and a top jack assembly being provided above the supporting tower and a mold supporting frame being provided on the top jack assembly, and a mold plate assembly being set up on the mold supporting frame, wherein the top jack assembly is provided for adjusting longitudinal and transverse gradients of the mold supporting frame.

12. The system as set forth in claim 11, wherein the railway assembly includes aggregate paved on the ground, lining plates covered on the aggregate, and railways placed on the lining plates.

13. The system as set forth in claim 12, wherein the railways are constructed by longitudinal and traverse steel H-beams.

14. The system as set forth in claim 11, further comprising lower frames to connect a plurality of said movable devices.

15. The system as set forth in claim 11, wherein each of the framework supporting units is a rectangular parallelepiped supporting framework constructed by a plurality of steel frames.

16. The system as set forth in claim 11, wherein the framework supporting units are locked by a plurality of locking blocks and latches.

17. The system as set forth in claim 11, wherein the mold supporting frame is constructed by a plurality of steel H-beams.

* * * * *